US010927640B2

(12) United States Patent
Solbakk et al.

(10) Patent No.: US 10,927,640 B2
(45) Date of Patent: Feb. 23, 2021

(54) SINGLE-TRIP WELLBORE LINER DRILLING SYSTEM

(71) Applicant: Halliburton Energy Services, Inc., Houston, TX (US)

(72) Inventors: Tommy Harald Nyheim Solbakk, Hafrsfjord (NO); Helge Rørvik, Sandnes (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/346,453

(22) PCT Filed: Nov. 29, 2017

(86) PCT No.: PCT/US2017/063790

§ 371 (c)(1),
(2) Date: Apr. 30, 2019

(87) PCT Pub. No.: WO2018/102459

PCT Pub. Date: Jun. 7, 2018

(65) Prior Publication Data

US 2019/0301266 A1 Oct. 3, 2019

Related U.S. Application Data

(60) Provisional application No. 62/428,683, filed on Dec. 1, 2016.

(51) Int. Cl.
*E21B 33/14* (2006.01)
*E21B 7/04* (2006.01)
(Continued)

(52) U.S. Cl.
CPC ..... *E21B 33/14* (2013.01); *E21B 7/04* (2013.01); *E21B 7/20* (2013.01); *E21B 7/28* (2013.01); *E21B 43/10* (2013.01); *E21B 49/003* (2013.01)

(58) Field of Classification Search
CPC ... E21B 7/20; E21B 33/14; E21B 7/04; E21B 7/28; E21B 43/10; E21B 49/003
See application file for complete search history.

(56) References Cited

U.S. PATENT DOCUMENTS 5,074,366 A 12/1991 Karlsson et al.
6,196,336 B1 3/2001 Fincher et al.
(Continued)

OTHER PUBLICATIONS

ISRWO International Search Report and Written Opinion for PCT/US2017/063790 dated Feb. 20, 2018.
(Continued)

*Primary Examiner* — Brad Harcourt
(74) *Attorney, Agent, or Firm* — Benjamin Ford; C. Tumey Law Group PLLC

(57) ABSTRACT

A drilling system can include a downhole assembly with a liner hanger, a liner running tool, a lower wellbore liner, a cementing module, and a drilling tool. The drilling system can provide a single-trip procedure that enables a well operator to drill the wellbore while simultaneously running in a wellbore liner and subsequently cement the annulus around the lower wellbore liner. Once the cement is deposited, a liner hanger can be actuated and a liner running tool released to enable the remaining portions of the downhole assembly to be pulled out of hole while leaving the lower wellbore liner cemented in place.

20 Claims, 3 Drawing Sheets

(51) Int. Cl.

| | |
|---|---|
| ***E21B 7/28*** | (2006.01) |
| ***E21B 43/10*** | (2006.01) |
| ***E21B 49/00*** | (2006.01) |
| ***E21B 7/20*** | (2006.01) |

(56) References Cited

U.S. PATENT DOCUMENTS

| | | | | |
|---|---|---|---|---|
| 7,004,263 | B2 | 2/2006 | Moriarty et al. | |
| 7,108,080 | B2 | 9/2006 | Tessari et al. | |
| 9,022,113 | B2 | 5/2015 | Rex et al. | |
| 2003/0132032 | A1 | 7/2003 | Metcalfe et al. | |
| 2004/0221997 | A1 | 11/2004 | Giroux et al. | |
| 2004/0256157 | A1* | 12/2004 | Tessari | E21B 43/10 175/57 |
| 2011/0315378 | A1* | 12/2011 | Homan | E21B 17/00 166/254.2 |
| 2013/0069655 | A1 | 3/2013 | McElhinney et al. | |
| 2016/0115764 | A1* | 4/2016 | Farley | E21B 43/108 166/285 |

OTHER PUBLICATIONS

Extended European Search Report for Application No. EP17875347 dated Jun. 8, 2020.

* cited by examiner

SINGLE-TRIP WELLBORE LINER DRILLING SYSTEM

CROSS-REFERENCE TO RELATED APPLICATIONS

This application claims the benefit of PCT Application No. PCT/US2017/063790, entitled "SINGLE-TRIP WELLBORE LINER DRILLING SYSTEM," filed Nov. 29, 2017, which claims the benefit of U.S. Provisional Application No. 62/428,683, filed Dec. 1, 2016, the entirety of which is incorporated herein by reference.

TECHNICAL FIELD

The present description relates in general to drilling systems, and more particularly to, for example, without limitation, single-trip wellbore liner drilling systems.

BACKGROUND OF THE DISCLOSURE

Wells in the oil and gas industry are commonly drilled into the ground to recover natural deposits of hydrocarbons and other desirable materials trapped in subterranean geological formations. Wells are typically drilled by advancing a drill bit into the earth, and the drill bit is attached to the lower end of a "drill string" suspended from a drilling rig or platform. The drill string typically consists of a long string of sections of drill pipe that are connected together end-to-end to form a long shaft for driving the drill bit further into the earth. A bottom hole assembly containing various instrumentation and/or mechanisms is typically provided at the end of the drill string above the drill bit.

During drilling operations, a drilling fluid (or "mud") is typically pumped down the drill string to the drill bit where it is ejected into the forming borehole. The drilling fluid lubricates and cools the drill bit, and also serves to carry drill cuttings back to the surface within the annulus formed between the drill string and the borehole wall.

Once a well is drilled to a desired depth, the wellbore is commonly lined with sections of larger-diameter pipe, usually called casing or liner. Before installing the casing or liner in the wellbore, the drill string is removed from the borehole in a process commonly referred to as "tripping." The casing or liner is subsequently lowered into the well and cemented in place to protect the well from collapse and to isolate adjacent subterranean formations from each other. After the casing or liner is successfully installed in the wellbore, drilling may continue by again running the drill bit into the wellbore as coupled to the end of the drill string. The process of drilling, tripping, running casing, cementing the casing, and then drilling again is often repeated several times while extending (drilling) a wellbore to total depth.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The present disclosure is related to drilling and completing wells in the oil and gas industry and, more particularly, to a drilling system capable of drilling and setting a wellbore liner within the drilled wellbore in a single downhole run.

Conventional drilling can involve drilling, liner placement, and cementing to secure the wellbore liner. The process of drilling, tripping, running casing, cementing the casing, and then drilling again is often repeated several times while extending (drilling) a wellbore to total depth. As can be appreciated, this repetitive process is time consuming and costly.

Drilling systems in accordance with the present disclosure provides a single-trip procedure that enables a well operator to drill the wellbore while simultaneously running in a wellbore liner, and subsequently cement the annulus around the lower wellbore liner. After cementing, a liner hanger can be actuated and a liner running tool released to enable the remaining portions of a downhole assembly to be pulled out of hole while leaving the lower wellbore liner cemented in place. Such drilling systems can reduce operational risks and saving well operators money on reduced non-productive time and increased reservoir exposure.

Figure 1:
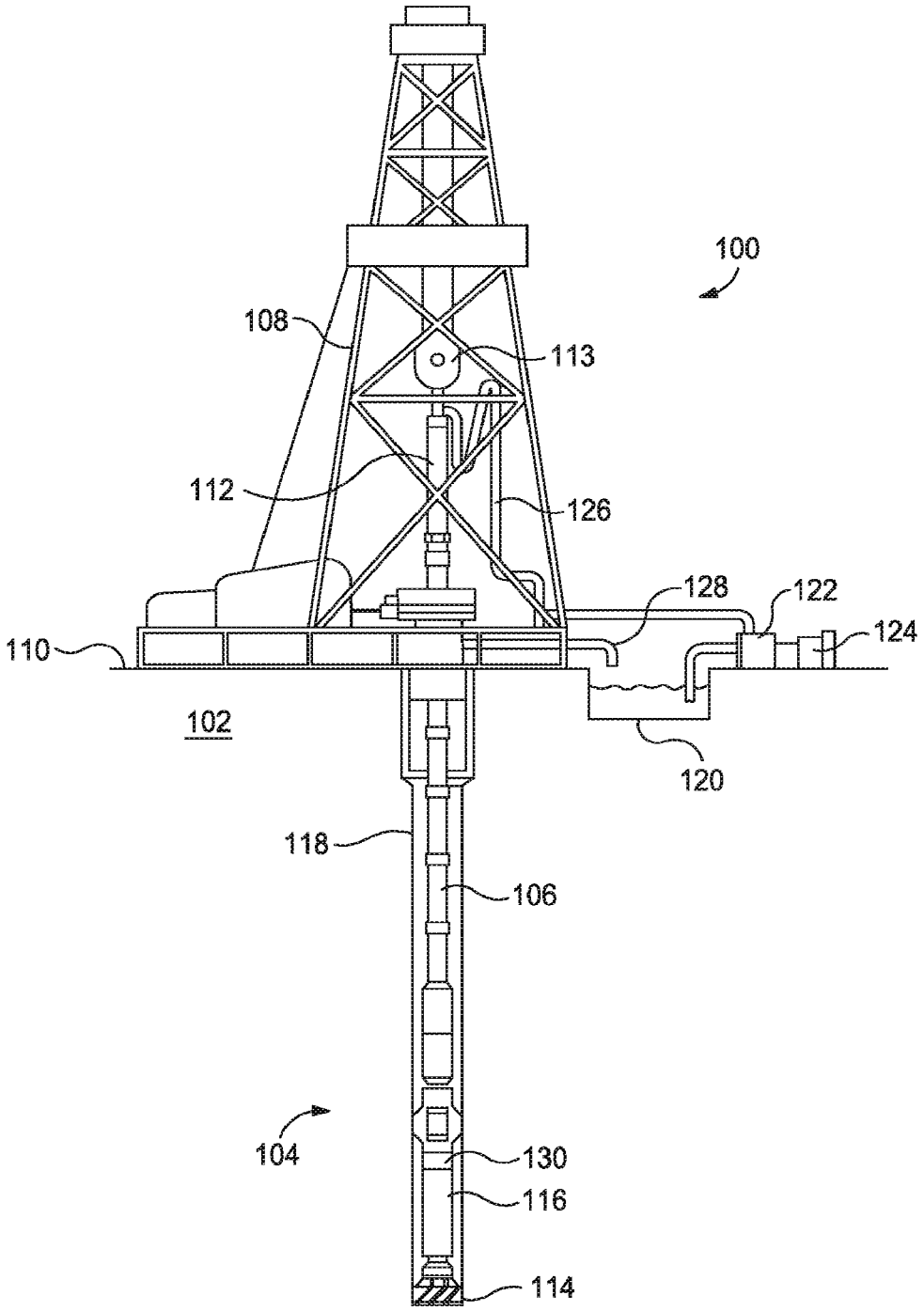
FIG. 1 is a drilling system operating a downhole assembly.

Referring to FIG. 1, illustrated is an exemplary drilling system 100 that may employ one or more principles of the present disclosure. Boreholes may be created by drilling into the earth 102 using the drilling system 100. The drilling system 100 may be configured to drive a downhole assembly 104 positioned or otherwise arranged at the bottom of a drill string 106 extended into the earth 102 from a derrick 108 arranged at the surface 110. The derrick 108 includes a kelly 112 and a traveling block 113 used to lower and raise the kelly 112 and the drill string 106.

The downhole assembly 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The downhole assembly 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 116, as shown in FIG. 1.

Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process returns drill cuttings and debris to the surface. The cuttings and mud mixture are passed through a flow line 128 and are processed such that a cleaned mud is returned down hole through the stand pipe 126 once again.

Although the drilling system 100 is shown and described with respect to a rotary drill system in FIG. 1, those skilled in the art will readily appreciate that many types of drilling systems can be employed in carrying out embodiments of the disclosure. For instance, drills and drill rigs used in embodiments of the disclosure may be used onshore (as depicted in FIG. 1) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

The drilling system 100 may further include computing equipment, such as computing and communications components 130 (e.g., a computer processor or firmware, one or more logic devices, volatile or non-volatile memory, and/or communications components such as antennas, communications cables, radio-frequency front end components, etc.). In some embodiments, the computing and communications components 130 may be included in the downhole assembly 104, as illustrated. In other embodiments, however, the computing and communications components 130 may be provided at the surface and communicably coupled to the downhole assembly 104 via known telecommunication means, such as mud pulse telemetry, electromagnetic telemetry, acoustic telemetry, any type of wired communication, any type of wireless communication, or any combination thereof. As described in more detail below, the communication components 130 may be used to control the vibration and actuation of one or more vibrational devices or other movable elements on or within the drill bit 114 to impart vibrations to the drill bit 114 (e.g., by controlling the amplitude and/or frequency of the vibrations). In some embodiments, communication components 130 may be used to determine and provide one or more vibrational frequencies for one or more vibrational devices on or within the drill bit 114 based on a bending strain and/or a mechanical torsion strain in the drill string 106, as discussed in further detail hereinafter.

Figure 2:
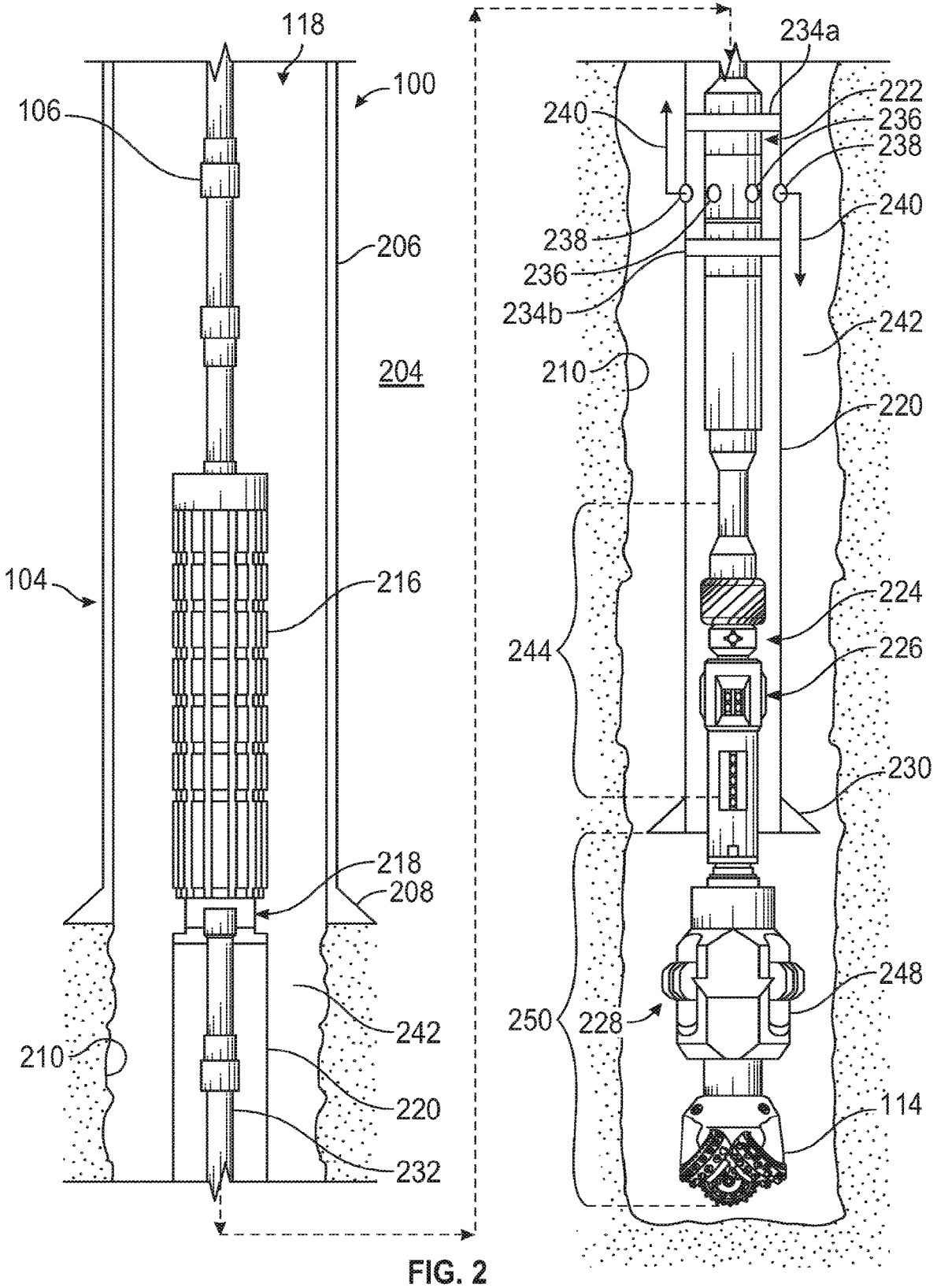
FIG. 2 is a schematic side view of a drilling system including a downhole assembly.

FIG. 2 shows a schematic side view of the drilling system 100 according to one or more embodiments of the present disclosure. As illustrated, the drilling system 100 can be extended into the wellbore 118 drilled through one or more subterranean formations 204. In some embodiments, an upper portion of the wellbore 118 may be lined with an upper wellbore liner 206 and secured in place using conventional wellbore cementing techniques. The upper wellbore liner 206 may comprise a plurality of pipe sections connected end-to-end, and may be referred to in the industry as "casing" or "wellbore liner." The upper wellbore liner 206 terminates at an upper liner shoe 208. Downhole from the upper liner shoe 208, portions of the drilling system 100 extend into an uncompleted portion 210 of the wellbore 118.

The downhole assembly 104 may include several pieces of downhole equipment and tools used to line and cement the uncompleted portion 210 of the wellbore 118. More specifically, the downhole assembly 104 may include a liner hanger 216, a liner running tool 218, a lower wellbore liner 220, a cementing module 222, a measurement module 224, a steering module 226, and one or more drilling tools 228.

The downhole assembly 104 may be operatively coupled to the drill string 106 at the liner hanger 216. As used herein, the term "operatively coupled" refers to a direct or indirect coupling engagement between two components. Accordingly, in some embodiments, the drill string 106 may be directly coupled to the liner hanger 216, but may alternatively be indirectly coupled thereto, such as via one or more other downhole tools (not shown) that interpose the end of the drill string 106 and the liner hanger 216. The liner hanger 216 may be used to attach or hang the lower wellbore liner 220 from the inner wall (surface) of the upper wellbore liner 206. To accomplish this, the liner hanger 216 may be configured to expand radially outward until engaging the inner wall of the upper wellbore liner 206. In some embodiments, the liner hanger 216 may be a VERSAFLEX® expandable liner hanger available from Halliburton Energy Services of Houston, Tex., USA.

The liner running tool 218 may be operatively coupled to the liner hanger 216 and the lower wellbore liner 220. The liner running tool 218 may be configured to run (carry) the lower wellbore liner 220 into the wellbore 118 and, more specifically, into the uncompleted portion 210 of the wellbore 118. The lower wellbore liner 220 may be similar to the upper wellbore liner 206, but of a smaller diameter. The lower wellbore liner 220 terminates at a lower liner shoe 230, which may be drillable.

The cementing module 222 may be operatively coupled to the liner running tool 218 and arranged within the lower wellbore liner 220 as the drilling system 100 is run into the wellbore 118. In the illustrated embodiment, one or more lengths of inner drill pipe 232 may be used to operatively couple the liner running tool 218 to the cementing module. The cementing module 222 may include upper seal 234*a* and lower seal 234*b* that fluidly and structurally isolate the cementing module 222 within the lower wellbore liner 220. The cementing module 222 may also include one or more cement ports 236 (two shown) arranged axially between the upper seal 234*a* and the lower seal 234*b*. The cement ports 236 may fluidly communicate with one or more liner ports 238 (two shown) defined in the lower wellbore liner 220. Consequently, cement 240 discharged from the cementing module 222 via the cement ports 236 may flow into the annulus 242 defined between the lower wellbore liner 220 and the inner wall of the uncompleted portion 210 of the wellbore 118 via the liner ports 238.

The measurement module 224 may include various measurement tools (not shown) such as, but not limited to, measurement-while-drilling (MWD) and logging-while-drilling (LWD) tools, that may be configured to take downhole measurements of drilling conditions. To allow the measurement tools (e.g., LWD sensors) to function properly, the lower wellbore liner 220 may include an electromagnetically transparent portion 244 and the measurement module 224 may be arranged within the lower wellbore liner 220 and axially aligned with the electromagnetically transparent portion 244. The electromagnetically transparent portion 244 may comprise any non-magnetic, electrically insulating/non-conductive material such as, but not limited to, a high temperature plastic, a thermoplastic, a polymer (e.g., polyimide), a ceramic, an epoxy material, or any non-metal material. The electromagnetically transparent portion 244 may be configured to allow electromagnetic signals emitted by the measurement module 224 (e.g., LWD sensors) to pass therethrough generally undisturbed by the lower wellbore liner 220, thereby mitigating any adverse effects on the log quality of the measurement tools. The remaining portions of the lower wellbore liner 220 may comprise a metal or any other material.

The measurement module 224 may operate in conjunction with the steering module 226 and provide real-time measurements of drilling conditions and parameters to help the steering module 226 accurately steer the drilling system 100 during drilling operations. The steering module 226 may comprise any rotary steerable tool. In at least one embodiment, the steering module 226 may comprise, for example, a GEO-PILOT® rotary steerable system available from Halliburton Energy Services of Houston, Tex., USA.

The drilling tools 228 may be used to drill and enlarge the diameter of the wellbore 118. As illustrated, the drilling tools 228 may include the drill bit 114 and a reamer 248 (alternately referred to as an "underreamer" or "hole enlargement device") axially offset from the drill bit 114. During drilling operations, the drill bit 114 drills a pilot hole and the reamer 248 enlarges the diameter of the pilot hole. The drilling tools 228 are operatively coupled to the drill string 106 such that rotation of the drill string 106 from the well surface location correspondingly rotates the drilling tools 228 to advance the drilling system 100 to drill the wellbore 118.

The outer diameter of the drill bit 114 and reamer 248 may be smaller than the inner diameter of the lower wellbore liner 220 to allow the drilling tools 228 to pass through the interior of the lower wellbore liner 220. In some embodiments, the reamer 248 may be radially actuatable to enable adjustment of the outer diameter of the reamer 248 for drilling operations or passing through the interior of the lower wellbore liner 220.

As illustrated, the drilling tools 228 may extend axially out the distal end of the lower wellbore liner 220 a short distance 250. In some embodiments, the short distance 250 may range between about 1.5 meters to about 2.0 meters, but could alternatively range between 1.2 meters and 2.5 meters, without departing from the scope of the disclosure. The short distance 250 may be sufficient to allow the drilling tools 228 to engage the underlying rock formation to increase the length (depth) of the wellbore 118.

The drilling system 100 may be first built or assembled at the well surface location. This can be accomplished by first lowering the entire length of the lower wellbore liner 220 into the wellbore 118 and "hanging" the lower wellbore liner 220 at the well surface location. In some embodiments, the lower wellbore liner 220 may be coupled to and otherwise "hung off" a rotary table forming part of the drilling rig or platform at the well surface location. The drilling tools 228, the steering module 226, the measurement module 224, and the cementing module 222 may then be extended into the interior of the lower wellbore liner 220 and the liner running tool 218 may then be coupled to the lower wellbore liner 220. In some embodiments, the entire downhole assembly 104 (minus the lower wellbore liner 220) may be coupled to the lower wellbore liner 220 using a false rotary table forming part of the drilling rig or platform at the well surface location.

While assembling the downhole assembly 104, the length of the inner drill pipe 232 may be adjusted (i.e., lengthened or shortened) to axially align the measurement module 224 with the electromagnetically transparent portion 244 of the lower wellbore liner 220. The inner drill pipe 232 may then be operatively coupled to the liner running tool 218 and the cementing module 222. The liner hanger 216 may then be operatively coupled to the liner running tool 218 to complete the assembly of the downhole assembly 104. Once properly assembled at the well surface location, the downhole assembly 104 is then ready to be detached (released) from the rotary table at the well surface location and run downhole into the wellbore 118 through the upper wellbore liner 206.

Figure 3:
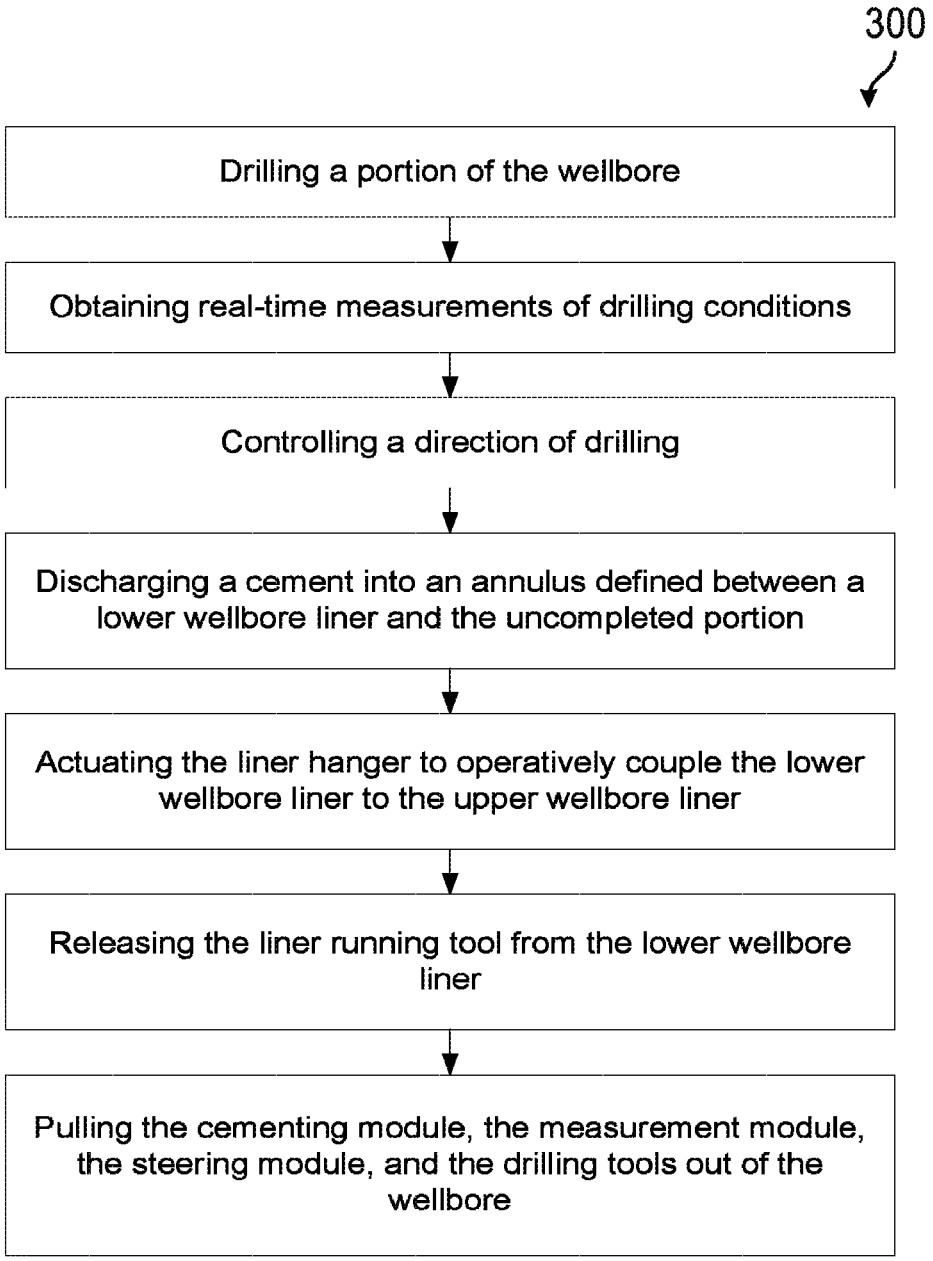
FIG. 3 is a flow chart of an exemplary operation of a drilling system.

An exemplary operation is shown in FIG. 3. In the operation 300, the drilling system 100 is run into the wellbore 118 on the drill string 106 until locating ("tagging") the bottom of the wellbore 118 below the upper liner shoe 208. Once the bottom of the wellbore 118 is located, drilling operations may commence to extend the length of the wellbore 118. This may be accomplished by circulating drilling fluid through the drilling system 100 from the well surface location and to the drilling tools 228 while simultaneously rotating the drilling tools. At the drilling tools 228, the drilling fluid is ejected from the drill bit 114 and the reamer 248 and into the annulus 242 to cool the drilling tools 228 and carry drill cuttings out of the wellbore 118 via the annulus 242. The direction of the drilling system 100 is controlled by the steering module 226 in communication with the measurement module 224. The measurement module 224 provides real-time measurements of drilling conditions that can be processed by the steering module 226 to update the direction, speed, and general operation of the drilling tools 228.

Drilling continues until the wellbore 118 is extended to a desired wellbore depth and the uncompleted portion 210 of the wellbore 118 is generated. Once reaching the desired wellbore depth, the wellbore 118 may be cleaned by circulating a fluid through the wellbore 118 that serves to remove remaining debris.

Once the wellbore is cleaned, cement 240 may then be pumped into the annulus 242 to secure the lower wellbore liner 220 within the uncompleted portion 210 of the wellbore 118. To facilitate pumping of the cement 240 into the annulus 242, a wellbore projectile (not shown), such as a dart, a ball, or a plug, may be pumped into the downhole assembly 104 and land on a seat (not shown) provided within the cementing module 222. Landing the wellbore projectile on the seat provides a fluid seal within the cementing module 222 that isolates lower portions of the downhole assembly 104 from upper portions thereof. The cement 240 may then be pumped into the downhole assembly 104 from the well surface location via the drill string 106. The fluid seal provided by the wellbore projectile forces the cement 240 to be discharged from the cementing module 222 via the cement ports 236 and subsequently into the annulus 242 via the liner ports 238 defined in the lower wellbore liner 220. The upper seal **234*a* and the lower seal 234*b* prevent the cement 240 from entering the axially adjacent lengths of the lower wellbore liner 220 and instead force the cement 240 into the annulus 242 via the liner ports 238**.

Once the cement 240 is deposited in the annulus 242, the liner hanger 216 may then be actuated to operatively couple the lower wellbore liner 220 to the upper wellbore liner 206. Actuation of the liner hanger 216 may be accomplished by pumping a second wellbore projectile (not shown), such as a dart, a ball, or a plug, into the liner hanger 216 to land on a seat (not shown) provided within the liner hanger 216.

Landing the wellbore projectile on the seat within the liner hanger 216 provides a fluid seal within the downhole assembly 104. Fluid pressure within the drill string 106 may then be increased to hydraulically actuate the liner hanger 216 and thereby secure it to the upper wellbore liner 206.

Once the liner hanger 216 is properly actuated and the lower wellbore liner 220 is effectively coupled to and otherwise "hung off" the upper wellbore liner 206, the liner running tool 218 may then be released from the lower wellbore liner 220. Releasing the liner running tool 218 allows the remaining portions of the downhole assembly 104 to be removed from the wellbore 118, alternately referred to as "pulled out of hole." More specifically, once the liner running tool 218 is released, the drill string 106 may be retracted back uphole towards the well surface location and simultaneously retract the cementing module 222, the measurement module 224, the steering module 226, and the drilling tools 228.

Accordingly, the drilling system 100 provides a single-trip system that enables a well operator to directionally drill the wellbore 118 while simultaneously running in the lower wellbore liner 220, and subsequently cement the annulus 242 around the lower wellbore liner 220. Once the cement 240 is deposited, the liner hanger 216 may be actuated and the liner running tool 218 released to enable the remaining portions of the downhole assembly 104 to be pulled out of hole while leaving the lower wellbore liner 220 cemented in place. In some applications, the drilling system 100 may be referred to as a "steerable liner drilling system." The drilling system 100 may prove advantageous in reducing operational risks and saving well operators money on reduced non-productive time and increased reservoir exposure.

Various examples of aspects of the disclosure are described below as clauses for convenience. These are provided as examples, and do not limit the subject technology.

Clause A. A drilling system, comprising: a drill string extendable from a well surface location into a wellbore partially lined with an upper wellbore liner, and a downhole assembly coupled to a distal end of the drill string and comprising: a liner hanger operatively coupled to the drill string, a liner running tool operatively coupled to the liner hanger, a lower wellbore liner operatively coupled to the liner running tool and comprising an electromagnetically transparent portion, a cementing module operatively coupled to the liner running tool and arrangeable within the lower wellbore liner, the cementing module providing one or more cement ports that are positionable in fluid communication with one or more liner ports defined in the lower wellbore liner to discharge cement from the cementing module into an annulus defined between the lower wellbore liner and an uncompleted portion of the wellbore, and one or more drilling tools extendable axially out a distal end of the lower wellbore liner.

Clause B. A downhole assembly comprising: a liner hanger, a liner running tool operatively coupled to the liner hanger, a lower wellbore liner operatively coupled to the liner running tool, comprising an electromagnetically transparent portion, and defining one or more liner ports, a cementing module operatively coupled to the liner running tool, arrangeable within the lower wellbore liner, and defining one or more cement ports that are positionable in fluid communication with the one or more liner ports, and one or more drilling tools extendable axially out a distal end of the lower wellbore liner.

Clause C. A method, comprising: lowering a downhole assembly into a wellbore partially lined with an upper wellbore liner, the downhole assembly comprising: a liner hanger, a liner running tool operatively coupled to the liner hanger, a lower wellbore liner operatively coupled to the liner running tool and comprising an electromagnetically transparent portion, a cementing module operatively coupled to the liner running tool and arrangeable within the lower wellbore liner, and one or more drilling tools extendable axially out a distal end of the lower wellbore liner, drilling a portion of the wellbore with the one or more drilling tools and thereby generating an uncompleted portion of the wellbore, discharging a cement from the cementing module into an annulus defined between the lower wellbore liner and the uncompleted portion, actuating the liner hanger to operatively couple the lower wellbore liner to the upper wellbore liner, releasing the liner running tool from the lower wellbore liner, and pulling the cementing module, the measurement module, the steering module, and the drilling tools out of the wellbore.

Each of embodiments A, B, and C may have one or more of the following additional elements in any combination:

Element 1: one or more lengths of inner drill pipe used to operatively couple the liner running tool to the cementing module.

Element 2: wherein the cementing module comprises an upper seal and a lower seal that fluidly and structurally isolate the cementing module within the lower wellbore liner, and wherein the one or more cement ports are arranged axially between the upper seal and the lower seal.

Element 3: wherein the electromagnetically transparent portion comprises a material selected from the group consisting of a high temperature plastic, a thermoplastic, a polymer, a ceramic, an epoxy material, any non-metal material, or any combination thereof.

Element 4: wherein the steering module comprises a rotary steerable tool.

Element 5: wherein the drilling tools comprise a drill bit and a reamer axially offset from the drill bit.

Element 6: wherein the electromagnetically transparent portion allows electromagnetic signals emitted by the measurement module to pass through the lower wellbore liner undisturbed.

Element 7: wherein discharging the cement from the cementing module into the annulus comprises flowing the cement from the one or more cement ports to the one or more liner ports.

Element 8: wherein discharging the cement from the cementing module comprises: pumping a wellbore projectile into the downhole assembly and landing the wellbore projectile on a seat provided within the cementing module, and pumping the cement into the downhole assembly and forcing the cement out of the cementing module with the wellbore projectile forming a seal against the seat.

Element 9: the method further comprising fluidly and structurally isolating the cementing module within the lower wellbore liner with the upper seal and the lower seal.

Element 10: wherein actuating the liner hanger comprises: pumping a wellbore projectile into the liner hanger and landing the wellbore projectile on a seat provided within the liner hanger, and increasing a fluid pressure within the downhole assembly and thereby hydraulically actuating the liner hanger.

Element 11: wherein discharging the cement from the cementing module is preceded by circulating a fluid through the wellbore to remove drilling debris and thereby cleaning the uncompleted portion.

Element 12: wherein the drilling, discharging, actuating, and/or releasing are performed within a single downhole trip into the wellbore.

Element 13: wherein the obtaining and controlling are performed within the single downhole trip into the wellbore.

Element 14: a measurement module arranged within the lower wellbore liner and axially aligned with the electromagnetically transparent portion, and a steering module arranged within the lower wellbore liner and in communication with the measurement module to steer the downhole assembly during drilling operations.

Element 15: obtaining real-time measurements of drilling conditions with the measurement module while drilling the uncompleted portion, and controlling a direction of drilling with the steering module based at least partially on the real-time measurements.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. A downhole assembly comprising:

a liner hanger;

a liner running tool operatively coupled to the liner hanger;

a lower wellbore liner operatively coupled to the liner running tool, comprising an electromagnetically transparent portion, and defining one or more liner ports;

a cementing module operatively coupled to the liner running tool, arrangeable within the lower wellbore liner, and defining one or more cement ports that are positionable in fluid communication with the one or more liner ports;

an upper seal and a lower seal positioned to fluidly and structurally isolate the cementing module within the lower wellbore liner, wherein the seals are positioned to prevent cement from entering axially adjacent lengths of the lower wellbore liner and force the cement into an annulus via the liner ports; and one or more drilling tools extendable axially out a distal end of the lower wellbore liner.

2. The downhole assembly of claim 1, further comprising one or more lengths of inner drill pipe used to operatively couple the liner running tool to the cementing module.

3. The downhole assembly of claim 1, wherein the one or more cement ports are arranged axially between the upper seal and the lower seal.

4. The downhole assembly of claim 1, wherein the drilling tools comprise a drill bit and a reamer axially offset from the drill bit.

5. The downhole assembly of claim 1, further comprising:

a measurement module arranged within the lower wellbore liner and axially aligned with the electromagnetically transparent portion; and a steering module arranged within the lower wellbore liner and in communication with the measurement module to steer the downhole assembly during drilling operations.

6. The downhole assembly of claim 5, wherein the steering module comprises a rotary steerable tool.

7. A drilling system, comprising:

a drill string extendable from a well surface location into a wellbore partially lined with an upper wellbore liner; and a downhole assembly coupled to a distal end of the drill string and comprising:

a liner hanger operatively coupled to the drill string;

a liner running tool operatively coupled to the liner hanger;

a lower wellbore liner operatively coupled to the liner running tool and comprising an electromagnetically transparent portion;

a cementing module operatively coupled to the liner running tool and arrangeable within the lower wellbore liner, the cementing module providing one or more cement ports that are positionable in fluid communication with one or more liner ports defined in the lower wellbore liner to discharge cement from the cementing module into an annulus defined between the lower wellbore liner and an uncompleted portion of the wellbore;

an upper seal and a lower seal positioned to fluidly and structurally isolate the cementing module within the lower wellbore liner, wherein the seals are positioned to prevent cement from entering axially adjacent lengths of the lower wellbore liner and force the cement into the annulus via the liner ports; and one or more drilling tools extendable axially out a distal end of the lower wellbore liner.

8. The drilling system of claim 7, further comprising one or more lengths of inner drill pipe used to operatively couple the liner running tool to the cementing module.

9. The drilling system of claim 7, wherein the one or more cement ports are arranged axially between the upper seal and the lower seal.

10. The drilling system of claim 7, wherein the drilling tools comprise a drill bit and a reamer axially offset from the drill bit.

11. The drilling system of claim 7, further comprising:

a measurement module arranged within the lower wellbore liner and axially aligned with the electromagnetically transparent portion; and a steering module arranged within the lower wellbore liner and in communication with the measurement module to steer the downhole assembly during drilling operations.

12. The drilling system of claim 11, wherein the steering module comprises a rotary steerable tool.

13. A method, comprising:

lowering a downhole assembly into a wellbore partially lined with an upper wellbore liner, the downhole assembly comprising:

a liner hanger;

a liner running tool operatively coupled to the liner hanger;

a lower wellbore liner operatively coupled to the liner running tool and comprising an electromagnetically transparent portion;

a cementing module operatively coupled to the liner running tool and arrangeable within the lower wellbore liner, the cementing module providing one or more cement ports that are positionable in fluid communication with one or more liner ports defined in the lower wellbore liner to discharge cement from the cementing module into an annulus defined between the lower wellbore liner and an uncompleted portion of the wellbore;

an upper seal and a lower seal positioned to fluidly and structurally isolate the cementing module within the lower wellbore liner; and one or more drilling tools extendable axially out a distal end of the lower wellbore liner;

drilling a portion of the wellbore with the one or more drilling tools and thereby generating an uncompleted portion of the wellbore;

discharging a cement from the cementing module into an annulus defined between the lower wellbore liner and the uncompleted portion, wherein the seals are positioned to prevent the cement from entering axially adjacent lengths of the lower wellbore liner and force the cement into the annulus via the liner ports;

actuating the liner hanger to operatively couple the lower wellbore liner to the upper wellbore liner;

releasing the liner running tool from the lower wellbore liner; and pulling the cementing module and the drilling tools out of the wellbore.

14. The method of claim 13, wherein discharging the cement from the cementing module into the annulus comprises flowing the cement from the one or more cement ports to the one or more liner ports.

15. The method of claim 13, wherein discharging the cement from the cementing module comprises:

pumping a wellbore projectile into the downhole assembly and landing the wellbore projectile on a seat provided within the cementing module; and pumping the cement into the downhole assembly and forcing the cement out of the cementing module with the wellbore projectile forming a seal against the seat.

16. The method of claim 15, further comprising fluidly and structurally isolating the cementing module within the lower wellbore liner with the upper seal and the lower seal.

17. The method of claim 13, wherein actuating the liner hanger comprises:

pumping a wellbore projectile into the liner hanger and landing the wellbore projectile on a seat provided within the liner hanger; and increasing a fluid pressure within the downhole assembly and thereby hydraulically actuating the liner hanger.

18. The method of claim 13, wherein discharging the cement from the cementing module is preceded by circulating a fluid through the wellbore to remove drilling debris and thereby cleaning the uncompleted portion.

19. The method of claim 13, wherein:

the downhole assembly further comprises:

a measurement module arranged within the lower wellbore liner and axially aligned with the electromagnetically transparent portion; and a steering module arranged within the lower wellbore liner and in communication with the measurement module; and the method further comprises:

obtaining real-time measurements of drilling conditions with the measurement module while drilling the uncompleted portion; and controlling a direction of drilling with the steering module based at least partially on the real-time measurements.

20. The method of claim 13, wherein the drilling, discharging, actuating, and releasing are performed within a single downhole trip into the wellbore.

* * * * *